US006169362B1

(12) United States Patent
Klinedinst et al.

(10) Patent No.: US 6,169,362 B1
(45) Date of Patent: Jan. 2, 2001

(54) MERCURY VAPOR DISCHARGE LAMP CONTAINING MEANS FOR REDUCING LEACHABLE MERCURY

(75) Inventors: Keith A. Klinedinst, Hudson; Dennis B. Shinn, Topsfield; Richard A. Fowler, Ipswich, all of MA (US)

(73) Assignee: Orsam Sylvania Inc., Danvers, MA (US)

( * ) Notice: Under 35 U.S.C. 154(b), the term of this patent shall be extended for 0 days.

(21) Appl. No.: 09/264,935

(22) Filed: Mar. 9, 1999

(51) Int. Cl.[7] ..... H01J 61/72; H01J 61/20

(52) U.S. Cl. ..... 313/565; 313/546; 313/485; 313/639

(58) Field of Search ..... 313/565, 546, 313/485, 638, 639, 642, 490, 493; 445/2, 61, 73

(56) References Cited

U.S. PATENT DOCUMENTS

| | | | | |
|---|---|---|---|---|
| 5,229,686 | | 7/1993 | Fowler et al. | 313/565 |
| 5,229,687 | | 7/1993 | Fowler et al. | 313/565 |
| 5,736,813 | | 4/1998 | Foust et al. | 313/490 |
| 5,754,002 | * | 5/1998 | Haitko et al. | 313/565 |
| 5,777,434 | | 7/1998 | Dietrich et al. | 313/565 |
| 5,994,838 | * | 11/1999 | Klinedinst et al. | 313/565 |

OTHER PUBLICATIONS

*Federal Register,* pp. 26987–26998, vol. 55, No. 126, Jun. 29, 1990.

* cited by examiner

*Primary Examiner*—Michael H. Day
(74) *Attorney, Agent, or Firm*—Carlo S. Bessone

(57) ABSTRACT

An improvement in a mercury vapor discharge lamp having an envelope of light-transmitting vitreous material containing an inert starting gas and a quantity of elemental mercury at least in part convertible to soluble mercury, and first and second electrodes located within the envelope for an arc discharge therebetween. The improvement comprises an effective amount of a soluble copper-containing compound in combination with an effective amount of a selected one of a group of materials consisting of a soluble chloride, a soluble bromide, a soluble nonmetallic iron-containing compound, and a soluble nonmetallic manganese-containing compound. The copper-containing compound and the material in combination, when the lamp is pulverized into granules and subjected to a suitable aqueous acid solution, produce a concentration of extracted mercury of less than 0.2 mg/l of the aqueous solution. The effective amount of the copper-containing compound is substantially smaller than is required to produce the concentration of extracted mercury without the materials present, and the effective amount of the selected material is smaller than is required to produce the concentration of extracted mercury without the copper-containing compound present.

6 Claims, 14 Drawing Sheets

MERCURY VAPOR DISCHARGE LAMP CONTAINING MEANS FOR REDUCING LEACHABLE MERCURY

BACKGROUND OF THE INVENTION

1. Field of the Invention

This invention relates to improvements in fluorescent lamps and is directed more particularly to providing a mercury vapor discharge lamp containing means for reducing leachable mercury.

2. Description of the Prior Art

During the manufacture of a fluorescent lamp, a quantity of elemental mercury is sealed within the lamp envelope. It is known that after a period of operation most of the elemental mercury adheres to a phosphor coating deposited on the inside wall of the lamp envelope, leaving a small portion of the mercury in the form of mercury vapor. During lamp operation, a portion of the mercury may be converted to a water-soluble mercury compound, such as mercuric oxide (HgO).

There is growing concern that a waste stream resulting from the disposal of fluorescent lamps may leach environmentally harmful amounts of this soluble form of mercury. One method of measuring the amount of soluble mercury which may leach from the waste stream resulting from the disposal of fluorescent lamps is described in a Toxicity Characteristic Leaching Procedure (TCLP) prescribed on pages 26987–26998 of volume 55, number 126 of the Jun. 29, 1990 issue of the Federal Register. According to the procedure, the lamp being tested is crushed, ground, cut, or otherwise particulated, into granules having a "surface area per gram of material equal to or greater than 3.1 $cm^2$ or having a particle size smaller than 1 cm in its narrowest dimension, i.e., is capable of passing through a 9.5 mm (0.375 inch) standard sieve." Following particulation, the granules are subjected to an extract solution comprising a sodium acetate buffer solution having a pH of approximately 4.93 and having a weight twenty times the weight of the granules.

The Environmental Protection Agency (EPA) defines a regulatory threshold for mercury at 0.2 milligram leachable mercury per liter of extract solution when the TCLP is applied. According to present standards, a fluorescent lamp is considered "nonleachable") when less than 0.2 milligram of leachable mercury per liter of extract solution results from a TCLP extraction.

Various methods have been proposed which attempt to treat or process burned-out discharge lamps, or scrap lamp exhaust tubing, containing mercury, in order to reclaim the mercury and thereby reduce the amount of mercury-contaminated scrap. In U.S. Pat. No. 5,229,686, issued Jul. 20, 1993 to Richard A. Fowler et al.; and U.S. Pat. No. 5,229,687, issued Jul. 20, 1993 to Richard A. Fowler et al., there are described methods by which to render a mercury vapor lamp "nonleaching") upon disposal without the use of expensive treatment processes to reclaim the mercury. The method described in '686 employs a chemical agent enclosed within the lamp, and which is suitable for chemically combining with a substantial portion of the soluble mercury as a sparingly soluble salt when the lamp is pulverized. The method described in '687 employs a chemical agent enclosed within the lamp, suitable for electrochemically reducing a substantial portion of the soluble mercury to elemental mercury when the lamp is pulverized. Preferably, this chemical agent is an element which has an electrode potential for oxidation reactions higher than mercury, but which is not sufficiently active to displace hydrogen from acidic aqueous solutions. In a preferred embodiment, the chemical agent is sealed within an enclosure (e.g., glass) which is rupturable upon pulverization of the lamp. In another embodiment, the chemical agent is mixed with the basing cement used to secure the lamp bases to the glass envelope. The chemical agent acts to reduce soluble mercury produced during lamp operation to elemental mercury, which is not leachable as measured by the TCLP.

The chemical agent used in '687 may be used in various forms, e.g., as a powder, dust, wire mesh, or metallic foil. The amount or size of the chemical agent is directly related to the surface area and surface condition, finely divided metallic powders being preferred over a solid mass because of their relatively large effective surface areas. Because of their availability and inexpensive cost, iron and copper, in the form of a powder or dust, are preferred. The amount of chemical agent present should be sufficient to electrochemically reduce the amount of soluble mercury within the lamp which is leached, at the time of disposal, to less than 0.2 milligram per liter of extract solution, as prescribed in the TCLP.

However, there are several disadvantages to the methods described in U.S. Pat. Nos. '686 and '687. In '686, the quantity of chemical agent required to chemically combine with nearly all of the mercury within a fluorescent lamp may be so large as to be inconvenient or impossible to contain within a standard lamp envelope. In '687, the metallic copper or iron reduces the amount of leachable mercury via a surface redox reaction between adsorbed mercury ions and zero-valent metal atoms. In order for this reaction to occur, the dissolved ionic mercury must first find its way to, and become adsorbed upon, the metal surface. Thus, the effectiveness of a metallic element as a means of reducing leachable mercury ultimately will be limited by the rates at which mercury ions diffuse into the metal surface and become adsorbed thereon. A means of reducing leachable mercury which does not depend upon chance contact between dissolved mercury ions and a metal surface, followed by the adsorption of the mercury into that surface, is deemed beneficial.

It is on occasion difficult or impossible to incorporate a sufficiently large quantity of a finely divided metal within a fluorescent lamp, particularly in the smaller or more compact lamps. In a small lamp, the only convenient way to introduce the metal often is as a component of the basing cement. However, the electrical conductivity of the metal may prevent its incorporation into the basing cement inasmuch as the cement may come into contact with internal electrical leads. On the other hand, electrically insulating materials easily are added to basing cement in addition to, or in place of, the normal $CaCO_3$ cement filler, without risk of creating electrical short circuits within the lamp.

In U.S. Pat. No. 5,736,813, issued Apr. 7, 1998 to Donald F. Foust et al., it is disclosed that "the formation of leachable mercury upon disposal, or during TCLP testing, of mercury vapor discharge lamps is substantially prevented by incorporation of a pH control agent in the lamp structure, or in the test solution, to provide a pH of about 5.5 to 6.5." A low pressure mercury discharge lamp is disclosed which includes about 5–15 grams of a pH control agent (generally a water-soluble base) which, it is suggested, is sufficient to substantially prevent formation of ferric and cupric compounds which oxidize elemental mercury to a soluble form. The primary disadvantage of this method of reducing mercury leaching is that it is difficult or, depending upon the lamp type, practically impossible to package the relatively large amounts of the required pH control agent (5–15 grams) within the structure of a typical mercury vapor lamp.

Recently, there has become known an improved mercury vapor discharge lamp in which is disposed an effective amount of a nonmetallic copper-containing compound which, when the lamp is pulverized to granules and subjected to a suitable aqueous acid extract solution, dissolves in the acid solution, resulting in a concentration of extracted mercury less than 0.2 mg per liter of extract solution. The effective amount of soluble copper is relatively small (between 0.1 and 4 mg per gram of total lamp weight, depending upon lamp type and size, total mercury loading, etc.); however, copper in the environment may be toxic to certain marine invertebrates. In order to eliminate the possibility of damage to ecological systems, the EPA has placed a limit of 25 mg/l for copper levels in discharges from nonferrous operations to lakes and streams. It is desirable, therefore, to minimize the amount of soluble copper which is used to control mercury leaching. Further, the smaller the quantity of nonmetallic copper-containing compound, the easier it is to incorporate within the body of the lamp.

It is known that compounds of manganese and iron soluble in the TCLP extraction fluid, as well as halides (NaCl and NaBr) have been shown to be effective as agents for the reduction of extractable mercury. However, as shown in FIG. 3 (a plot of the concentration of extracted Hg at the end of the TCLP test as a function of cupric acetate, ferric sulfate, or sodium chloride concentration in the extraction fluid for T8 lamps containing 4.5 mg of ionic mercury), soluble halides and iron-containing compounds are generally much less effective than copper-containing compounds present at comparable concentrations. Similarly, as shown in FIG. 4 (a plot of the concentration of extracted Hg at the end of the TCLP test as a function of copper acetate or dihydroxy carbonate concentration, on the one hand, or manganese acetate or carbonate concentration in the extraction fluid for T12 lamps containing 15 mg of ionic mercury), soluble manganese-containing compounds are generally much less effective than copper-containing compounds present at comparable concentrations.

Accordingly, there is a need for a mercury vapor discharge lamp containing means for reducing leachable mercury, as determined by the TCLP, to a concentration level of 0.2 milligrams, or less, of leachable mercury per liter of extract solution. There is further a need to limit the level of soluble copper used to limit the leachable mercury. There is still further a need to increase the effectiveness of compounds of manganese and iron and of soluble chloride and soluble bromide in reduction of extractable mercury.

SUMMARY OF THE INVENTION

An object of the invention is, therefore, to provide a mercury vapor discharge lamp containing means for reducing leachable mercury, as determined by the TCLP to a concentration level of 0.2 milligrams, or less, of leachable mercury per liter of extract solution, utilizing a copper-containing compound.

A further object of the invention is to limit the level of soluble copper used to limit the leachable mercury by use of effective amounts of selected ones of soluble chloride, soluble bromide, compounds of manganese, and compounds of iron.

A still further object of the invention is to increase the mercury reducing effectiveness of the aforementioned soluble chloride, soluble bromide, compound of manganese, and compound of iron.

With the above and other objects in view, as will hereinafter appear, a feature of the present invention is the provision in a mercury vapor discharge lamp, having an envelope of light-transmitting vitreous material containing an inert starting gas and a quantity of elemental mercury at least in part convertible to soluble mercury, and first and second electrodes located within the envelope for a discharge therebetween, of an improvement comprising an effective amount of a soluble copper-containing compound in combination with an effective amount of a selected one of a group of materials consisting of a soluble chloride, a soluble bromide, a soluble nonmetallic iron-containing compound, and a soluble nonmetallic manganese-containing compound. The copper-containing compound and the material in combination, when the lamp is particulated into granules and subjected to a suitable aqueous acid solution produce a concentration of extracted mercury of less than 0.2 milligrams/liter of the aqueous solution. The effective amount of the copper-containing compound is substantially smaller than is required to produce the concentration of extracted mercury without the selected material present, and the effective amount of the selected material is smaller than is required to produce the concentration of extracted mercury without the copper-containing compound present.

The above and other features of the invention, including various novel details of combinations of materials, will now be more particularly described with reference to the accompanying drawings and pointed out in the claims. It will be understood that the particular mercury vapor discharge lamps embodying the invention are shown and described by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention and results of tests conducted thereon, from which novel features and advantage of the invention will be apparent.

In the drawings.

DESCRIPTION OF THE PREFERRED EMBODIMENTS

Figure 1:
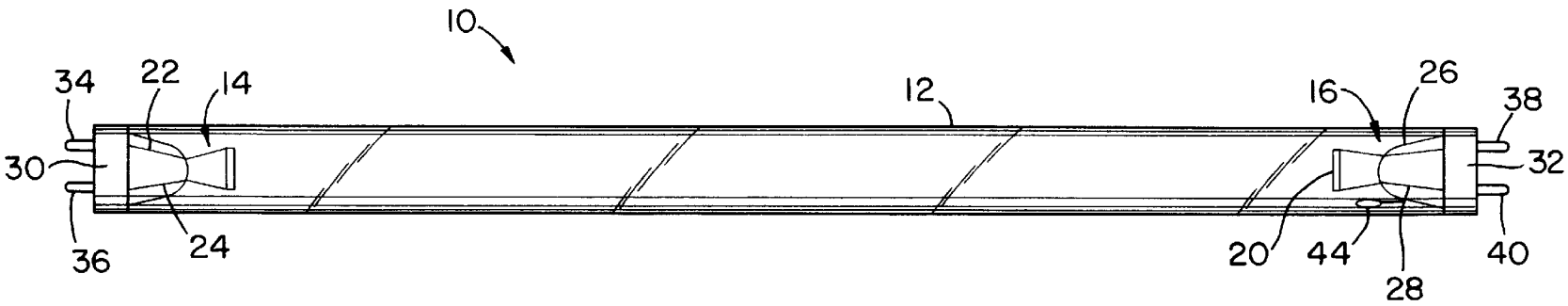
FIG. 1 is an elevational view of one form of lamp illustrative of an embodiment of the invention.

Referring to FIG. 1, there is shown a fluorescent lamp 10 having a sealed elongated envelope 12 of light-transmitting vitreous material. The envelope 12 is provided with opposing end portions 14, 16, and encloses an inert starting gas, such as neon, argon, or the like. A first electrode 18 and a second electrode 20 are located within the opposing end portions 14 and 16, respectively.

Figure 2:
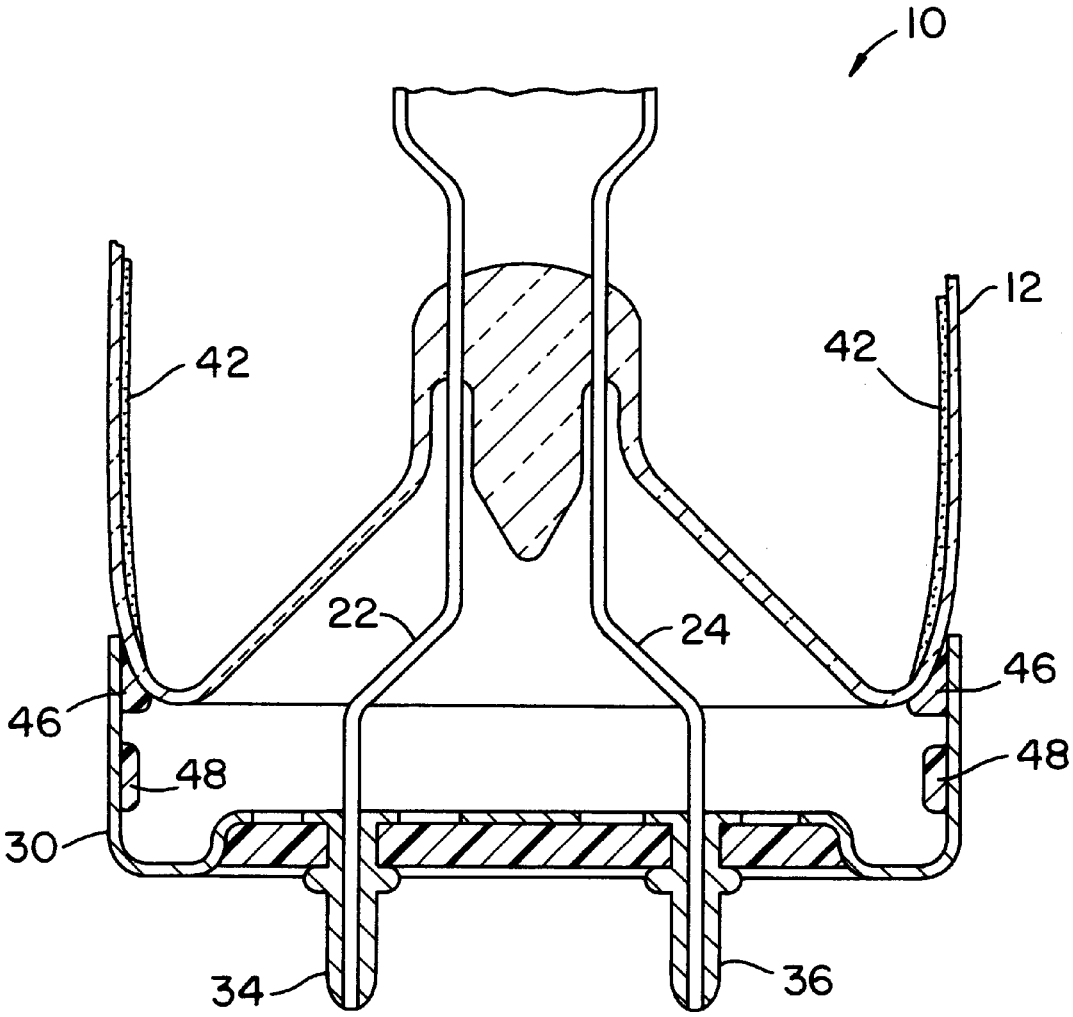
FIG. 2 is a sectional view of a portion of the lamp of FIG. 1.
Figure 3:
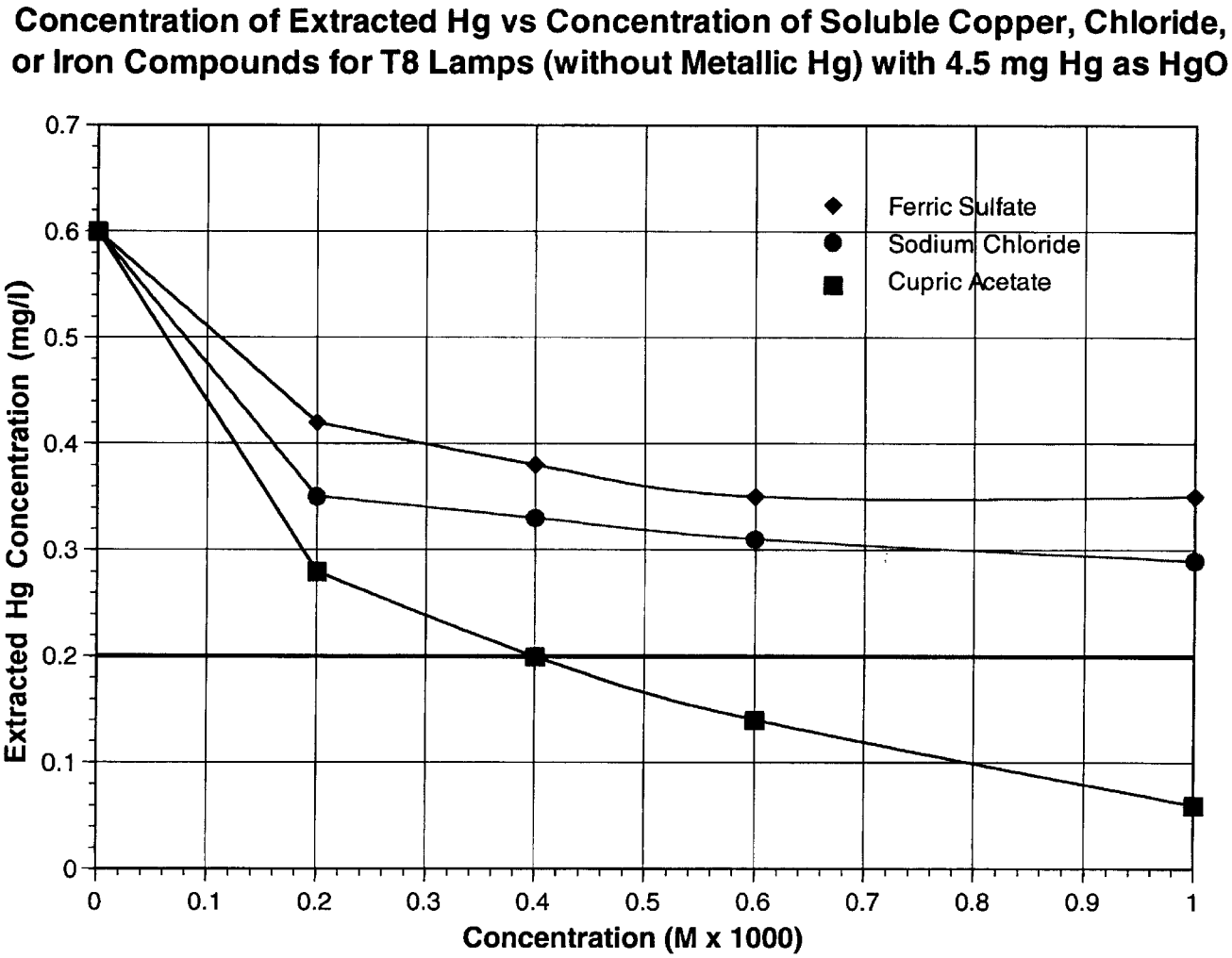
FIG. 3 is a graph illustrating extracted mercury concentration vs. concentration of a soluble copper, a soluble chloride, and a soluble iron compound.
Figure 4:
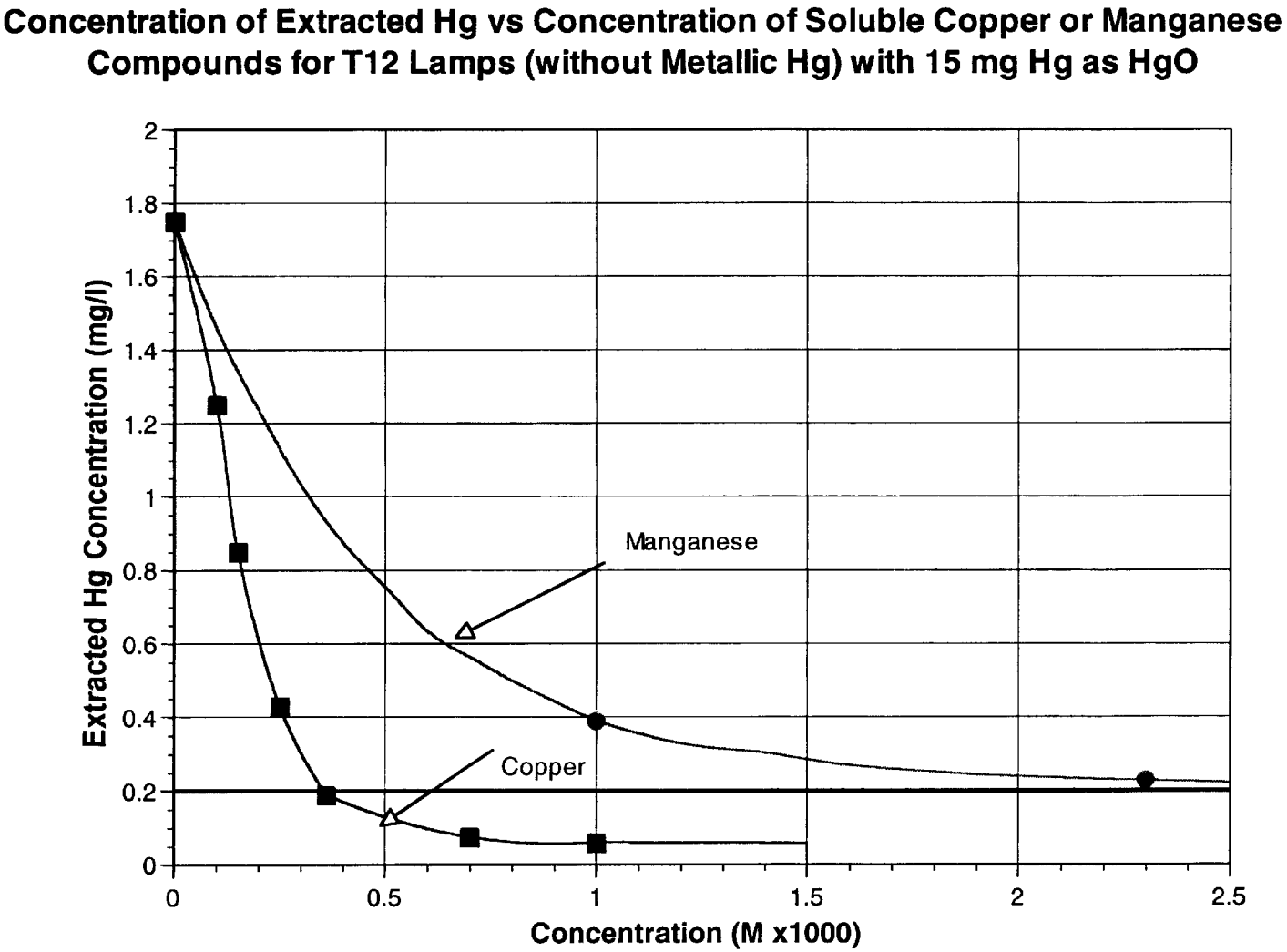
FIG. 4 is a graph illustrating extracted mercury concentration vs. concentration of soluble copper and soluble manganese.

Referring to FIG. 2, it will be seen that a first pair of lead-in wires 22, 24 connect to first electrode 18. Similarly, a second pair of lead-in wires 26, 28 (FIG. 1) connect to the second electrode 20. Suitable bases 30, 32, carrying brass contacts 34, 36 and 38, 40 are respectively sealed adjacent the end portions 14, 16. Lead-in wires 22, 24 and 26, 28 are electrically connected to the contacts 34, 36 and 38, 40, respectively.

As shown in FIG. 2, a phosphor coating 42 may be disposed on the interior surface of the envelope 12. The phosphor coating 42 is responsive to ultraviolet radiation generated in the envelope 12 during operation of the lamp to provide a desired emission spectrum.

As noted hereinabove, in the manufacture of the lamp 10 elemental mercury is sealed within the envelope 12. After a period of operation, most of the mercury adheres to the phosphor coating 42 with a small portion in the form of mercury vapor disposed in the envelope 12. During lamp operation, a portion of the mercury is converted to soluble mercuric oxide, which is leachable and which presents the aforementioned environmental problem upon disposal of the lamp.

It has been discovered that a relatively small amount of a soluble nonmetallic copper-containing compound used in combination with a quantity of material, the material consisting of a selected one of a soluble chloride, a soluble bromide, a soluble nonmetallic iron-containing compound, and a soluble nonmetallic manganese-containing compound, in the Toxicity Characteristic Leaching Procedure applied to a mercury vapor discharge lamp containing a quantity of mercury that is at least partially convertible to soluble mercury, is more effective in reducing the concentration of extracted mercury than either the copper-containing compound or the aforesaid selected material used alone. Thus, as a result of the presence of a soluble chloride, or soluble bromide, or soluble iron-containing, or manganese-containing compound, concentrations of extracted mercury less than 0.2 mg per liter of extraction solution are obtained with quantities of soluble copper-containing compounds substantially smaller than would be required to achieve the same extracted mercury concentrations in the absence of the soluble chloride or soluble bromide, or soluble iron or soluble manganese compound. Conversely, as a result of the presence of a soluble copper-containing compound, concentrations of extracted mercury less than 0.2 mg per liter of solution may be obtained with quantities of soluble chloride, or soluble bromide, or soluble iron-containing, or soluble manganese-containing compounds substantially smaller than would be required to achieve the same extracted mercury concentrations in the absence of the dissolved copper compound, (assuming such extracted mercury concentrations can be obtained at all in the absence of the dissolved copper).

In accordance with the invention, there is disposed in the lamp envelope 12 an effective amount of a nonmetallic copper-containing compound soluble in the aqueous acid solution employed in the Toxicity Characteristic Leaching Procedure (TCLP), along with an effective amount of a selected one of a group of materials consisting of a soluble chloride, a soluble bromide, a soluble nonmetallic iron-containing compound, and a soluble nonmetallic manganese-containing compound. The additives, which may be incorporated into the lamp in any one of a variety of ways, substantially reduce the amount of mercury that may be leached from the lamp as determined by the standard TCLP. The additives may be sealed within an enclosure 44 (FIG. 1) which is rupturable upon pulverization of the lamp. Alternatively, the materials may be mixed with a basing cement 46 used to secure lamp bases 30 and 32 to the glass envelope 12, as shown in FIG. 2, or may be mixed with a binder and incorporated as a separate phase 48 distinct from the basing cement 46 (FIG. 2). The quantities of materials needed to render the mercury partially or almost totally nonextractable are typically much smaller than these required in the prior art, as for example, in U. S. Pat. Nos. 5,229,686 and 5,229,687. Moreover, the effective amount of the copper-containing compound is substantially smaller than is required to produce the concentration of extracted mercury without the selected material present, and the effective amount of the selected material is smaller than is required to produce the concentration of extracted mercury without the copper-containing compound present. The advantages of this new approach are demonstrated in the following examples.

EXAMPLE 1

A series of TCLP tests were carried out with 32WT8 fluorescent lamps. So as to simulate the conditions present in fully exhausted lamps in which most of the metallic mercury may have been converted to the ionic water-soluble form, the lamps were fabricated without metallic mercury. Rather, when the TCLP tests were carried out, a quantity of water-soluble HgO was added equivalent to 4.5 mg of metallic mercury. No additives were used in one of the tests. However, all of the other tests included one or more additives which alone or in combination are more or less effective in reducing the amount of extracted mercury. The concentrations of the various additives along with the resulting leached mercury concentrations are listed in Table I below (wherein Ac is used to indicate the acetate anion, and M indicates moles of additive per liter of TCLP extraction solution).

TABLE I

TCLP Results for T8 Lamps without Metallic Hg, with 4.5 mg Dissolved $Hg^{2+}$ (from HgO), and with Soluble Copper-Containing, Iron-Containing, and/or Halide-Containing Compounds as Additives

| Soluble Additive Concentration In the TCLP Extraction Fluid | Leached Hg (mg/l) |
|---|---|
| None | 0.60 |
| $6.5 \times 10^{-5}$ M $Cu_2(OH)_2CO_3$ | 0.38 |
| $2 \times 10^{-4}$ M $CuAc_2$ | 0.28 |
| $4 \times 10^{-4}$ M $CuAc_2$ | 0.20 |
| $2 \times 10^{-4}$ M $Fe_2(SO_4)_3$ | 0.42 |
| $4 \times 10^{-4}$ M $Fe_2(SO_4)_3$ | 0.38 |

TABLE I-continued

TCLP Results for T8 Lamps without Metallic Hg, with 4.5 mg Dissolved $Hg^{2+}$ (from HgO), and with Soluble Copper-Containing, Iron-Containing, and/or Halide-Containing Compounds as Additives

| Soluble Additive Concentration In the TCLP Extraction Fluid | Leached Hg (mg/l) |
|---|---|
| $4 \times 10^{-4}$ M $FeAc_2$ | 0.28 |
| $10 \times 10^{-4}$ M $FeAc_2$ | 0.29 |
| $2 \times 10^{-4}$ M NaCl | 0.35 |
| $4 \times 10^{-4}$ M NaCl | 0.33 |
| $4.5 \times 10^{-4}$ M NaCl | 0.32 |
| $10 \times 10^{-4}$ M NaCl | 0.29 |
| $10 \times 10^{-4}$ M NaBr | 0.27 |
| $2 \times 10^{-4}$ M $CuAc_2$ + $2 \times 10^{-4}$ M $Fe_2(SO_4)_3$ | 0.16 |
| $2 \times 10^{-4}$ M $CuAc_2$ + $2 \times 10^{-4}$ M $FeSO_4$ | 0.17 |
| $2 \times 10^{-4}$ M $CuAc_2$ + $2 \times 10^{-4}$ M NaCl | 0.12 |
| $2 \times 10^{-4}$ M $CuAc_2$ + $2 \times 10^{-4}$ M NaBr | 0.11 |
| $6.5 \times 10^{-5}$ M $Cu_2(OH)_2CO_3$ + $4.5 \times 10^{-4}$ M NaCl | 0.11 |
| $2 \times 10^{-4}$ M CuCl | 0.15 |

The above data show that the leached mercury concentration obtained when soluble copper is combined with soluble chloride, bromide or iron-containing compounds is substantially lower than with any of the additives used alone. Moreover, essentially the same result has been obtained whether the additives (soluble copper and chloride in this example) are present as separate compounds ($CuAc_2$ and NaCl) or are combined within the same compound (CuCl).

EXAMPLE 2

Similar TCLP tests were performed using 32WT8 fluorescent lamps manufactured without metallic mercury but with 3.0 mg of ionic mercury (as HgO) soluble in the TCLP extraction fluid. No additives were used in one of the tests. However, in all of the other tests one or more additives, which alone or in combination are more or less effective in reducing the amount of extracted mercury, were used. The concentrations of the various additives along with the resulting leached mercury concentrations are listed in the table below. (In the table, CDC is an abbreviation for copper dihydroxy carbonate, $Cu_2(OH)_2CO_3$).

TABLE II

TCLP Results for T8 Lamps without Metallic Mercury, with 3.0 mg Dissolved $Hg^{2+}$ (from HgO), and with Soluble Copper-Containing, Iron-Containing, and/or Halide-Containing Compounds as Additives

| Soluble Additive Concentration In the TCLP Extraction Fluid | Leached Hg (mg/l) |
|---|---|
| None | 0.34 |
| $1.25 \times 10^{-4}$ M Cu (from CDC) | 0.26 |
| $2.0 \times 10^{-4}$ M Cl (from NaCl) | 0.23 |
| $4.0 \times 10^{-4}$ Fe (from $Fe_2(SO_4)_3$) | 0.27 |
| $1.25 \times 10^{-4}$ M Cu (from CDC) + $2.0 \times 10^{-4}$ M Cl (from NaCl) | 0.12 |
| $1.25 \times 10^{-4}$ M Cu (from CDC) + $4.0 \times 10^{-4}$ M Fe (from $Fe_2(SO_4)_3$) | 0.13 |
| $1.25 \times 10^{-4}$ M Cu (from CDC) + $5.0 \times 10^{-4}$ M Cl (from NaCl) | 0.09 |
| $1.25 \times 10^{-4}$ M Cu (from $CuAc_2$) + $5.0 \times 10^{-4}$ M Cl (from NaCl) | 0.09 |

These data show that the leached mercury concentration obtained when soluble copper is combined with soluble chloride, or soluble iron-containing compounds, is substantially lower than with any of the additives used alone. Moreover, the same result is obtained whatever the source of the soluble copper.

EXAMPLE 3

Similar TCLP tests were performed using 32WT8 fluorescent lamps manufactured without metallic mercury but with 10 mg of ionic mercury (as HgO) soluble in the TCLP extraction fluid. No additives were used in one of the tests. However, in each of the other tests one or more additives, which alone or in combination are more or less effective in reducing the amount of extracted mercury, were used. The additive concentrations, along with the resulting leached mercury concentrations, are listed in the table below.

TABLE III

TCLP Results for T8 Lamps without Metallic Mercury, with 10 mg Dissolved $Hg^{2+}$ (from HgO), and with Soluble Copper-Containing and/or Halide-Containing Compounds as Additives

| Soluble Additive Concentration In the TCLP Extraction Fluid | Leached Hg (mg/l) |
|---|---|
| None | 1.20 |
| $1.2 \times 10^{-4}$ M Cu (from $CuAc_2$) | 0.61 |
| $1.0 \times 10^{-3}$ M Cl (from NaCl) | 0.85 |
| $1.2 \times 10^{-4}$ M Cu (from $CuAc_2$) + $1.0 \times 10^{-3}$ M Cl (from NaCl) | 0.08 |

Again, these data show that the leached mercury concentration obtained when soluble copper is combined with soluble chloride is substantially lower than with either of the additives used alone.

EXAMPLE 4

Similar TCLP tests were performed using 40WT12 fluorescent lamps manufactured without metallic mercury but with 15 mg of ionic mercury (as HgO) soluble in the TCLP extraction fluid. No additives were used in one of the tests. However, in all of the other tests one or more additives, which alone or in combination are more or less effective in reducing the amount of extracted mercury, were used. The concentrations of the various additives along with the resulting leached mercury concentrations are listed in Table IV below. (In the table, CDC is an abbreviation for copper dihydroxy carbonate, $Cu_2(OH)_2CO_3$, and COC is an abbreviation for copper oxychloride, $Cu_2(OH)_3Cl$).

TABLE IV

TCLP Results for T12 Lamps without Metallic Hg, with 15 mg Dissolved $Hg^{2+}$ (from HgO), and with Soluble Copper-Containing and/or Chloride-Containing Compounds as Additives

| Soluble Additive Concentration In the TCLP Extraction Fluid | Leached Hg (mg/l) |
|---|---|
| None | 1.75 |
| $2.4 \times 10^{-4}$ M Cu (from CDC) | 0.43 |
| $2.4 \times 10^{-4}$ M Cu (from CDC) + $1.2 \times 10^{-4}$ M Cl (from NaCl) | 0.24 |
| $2.4 \times 10^{-4}$ M Cu (from COC) + $1.2 \times 10^{-4}$ M Cl (from COC) | 0.26 |
| $2.5 \times 10^{-4}$ M Cu (from $CuAc_2$) + $6.0 \times 10^{-4}$ M Cl (from NaCl) | 0.14 |
| $2.5 \times 10^{-4}$ M Cu (from $CuCl_2$) + $5.0 \times 10^{-4}$ M Cl (from $CuCl_2$) | 0.15 |
| $2.5 \times 10^{-4}$ M Cu (from CDC) + $2.0 \times 10^{-3}$ M Fe (from Fe (II) Fumerate) | 0.14 |

The data immediately above show that the leached mercury concentrations obtained when soluble copper is combined with soluble chloride or soluble iron are substantially below those obtained with soluble copper used alone. Moreover, essentially the same result is obtained whether the additives (soluble copper and chloride) are present as separate compounds (CDC or $CuAc_2$ and NaCl) or are combined within the same compound (COC or $CuCl_2$).

EXAMPLE 5

Figure 5:
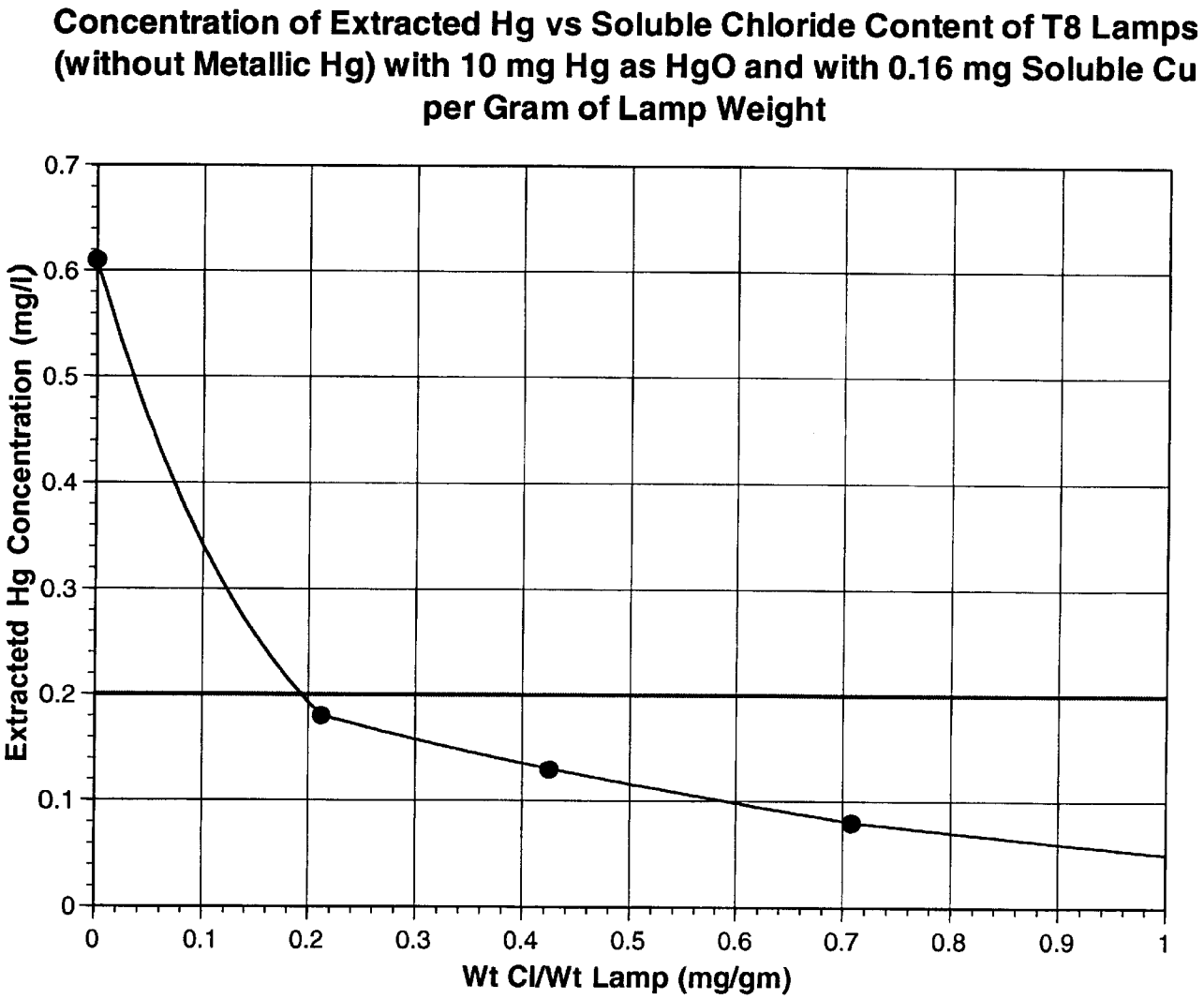
FIGS. 5 and 6 are graphs illustrating extracted mercury concentration vs. soluble chloride content per gram of lamp weight with soluble copper.

A series of four TCLP tests were carried out with 32WT8 fluorescent lamps manufactured without metallic mercury but with 10 mg of ionic mercury (as HgO) soluble in the TCLP extraction fluid. Also included in each test was 0.16 mg soluble copper (as $CuAc_2$) per gram of lamp weight. A quantity of soluble chloride (as NaCl) ranging between approximately 0.2 and 0.7 mg per gram of lamp weight was also included in three of the four tests. The concentration of extracted mercury is plotted as a function of chloride concentration in FIG. 5. As shown, whereas an extracted mercury concentration of approximately 0.6 mg per liter of extraction solution was measured in the test carried out without chloride addition, the presence of approximately 0.2 mg soluble chloride per gram of lamp weight was sufficient to reduce the extracted mercury concentration to below 0.2 mg per liter.

EXAMPLE 6

Figure 6:
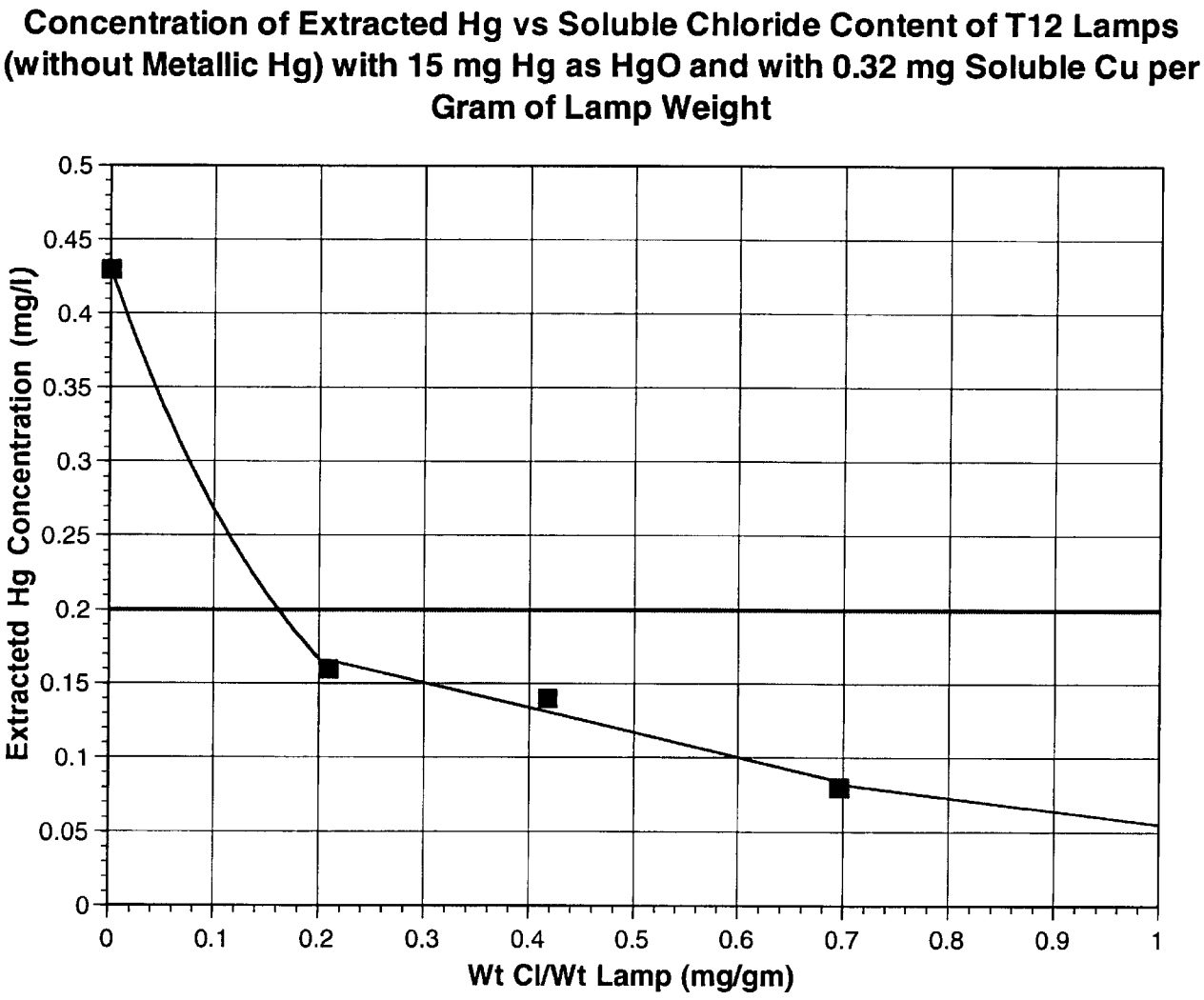

A series of four TCLP tests were carried out with 40WT12 fluorescent lamps manufactured without metallic mercury but with 15 mg of ionic mercury (as HgO) soluble in the TCLP extraction fluid. Also included in each test was 0.32 mg soluble copper (as $CuAc_2$) per gram of lamp weight. A quantity of soluble chloride (as NaCl) ranging between approximately 0.2 and 0.7 mg per gram of lamp weight was also included in three of the four tests. The concentration of extracted mercury is plotted as a function of chloride concentration in FIG. 6. As shown, whereas an extracted mercury concentration of approximately 0.4 mg per liter of extraction fluid was measured in the test carried out without chloride addition, the presence of approximately 0.2 mg soluble chloride per gram of lamp weight was sufficient to reduce the extracted mercury concentration to below 0.2 mg per liter.

EXAMPLE 7

Figure 7:
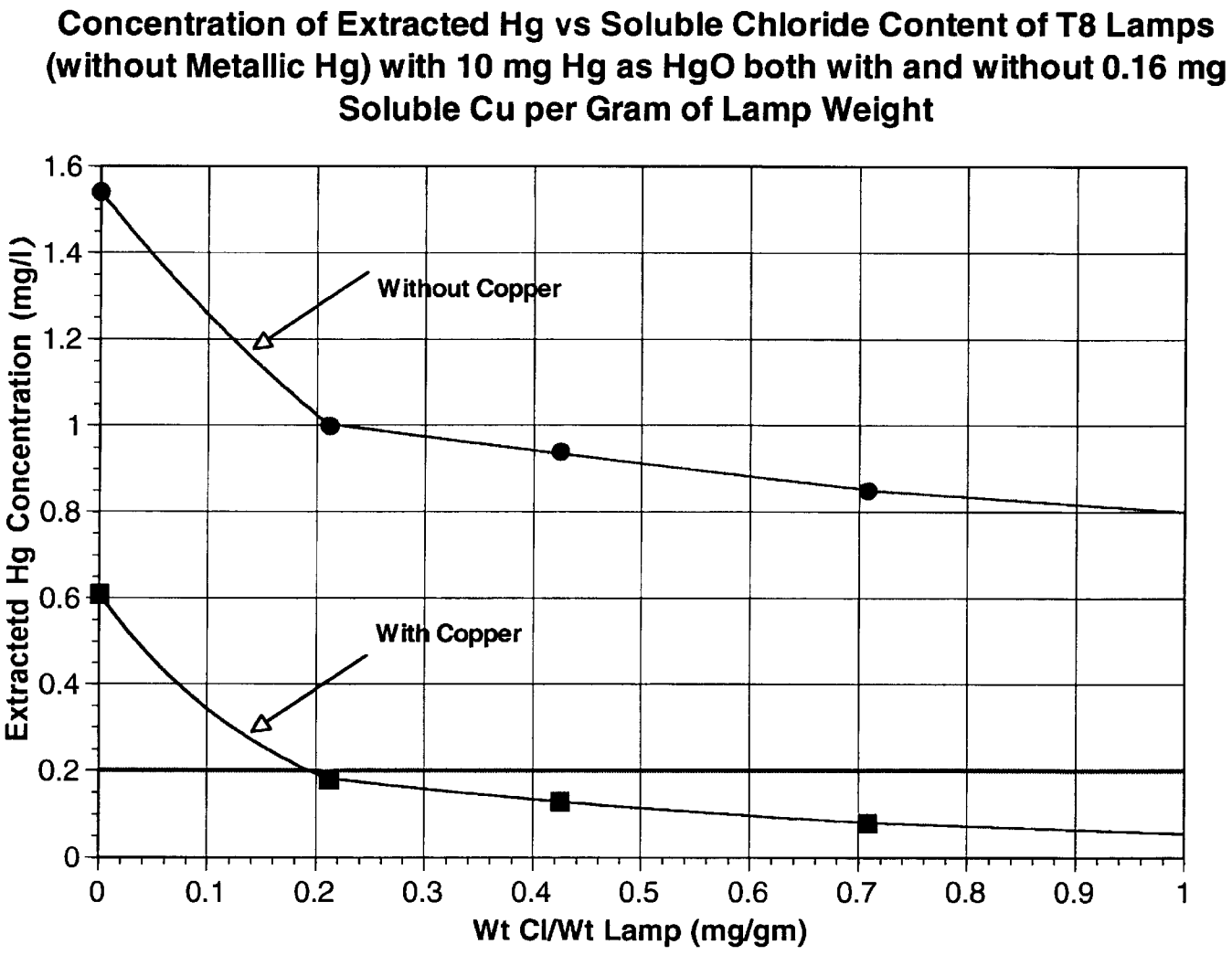
FIG. 7 is a graph illustrating extracted mercury concentration vs. content of soluble chloride with and without soluble copper.

Another series of four TCLP tests were carried out with 32WT8 fluorescent lamps manufactured without metallic mercury but with 10 mg of ionic mercury (as HgO) soluble in the TCLP extraction fluid. A quantity of soluble chloride (as NaCl) ranging between approximately 0.2 and 0.7 mg per gram of lamp weight was also included in three of the four tests. The concentration of extracted mercury is plotted as a function of chloride concentration in FIG. 7. Also included are the data previously plotted in FIG. 5 (Example 5) obtained with the addition of 0.16 mg soluble copper (as $CuAc_2$) per gram of lamp weight. As shown, in the absence of the soluble copper-containing compound, the extracted mercury concentrations were all in excess of 0.8 mg per liter, regardless of the amount of soluble chloride. In contrast, with the addition of only 0.16 mg soluble copper per gram of lamp weight, the presence of approximately 0.2 mg soluble chloride per gram of lamp weight was sufficient to reduce the extracted mercury concentration to below 0.2 mg per liter.

EXAMPLE 8

Figure 8:
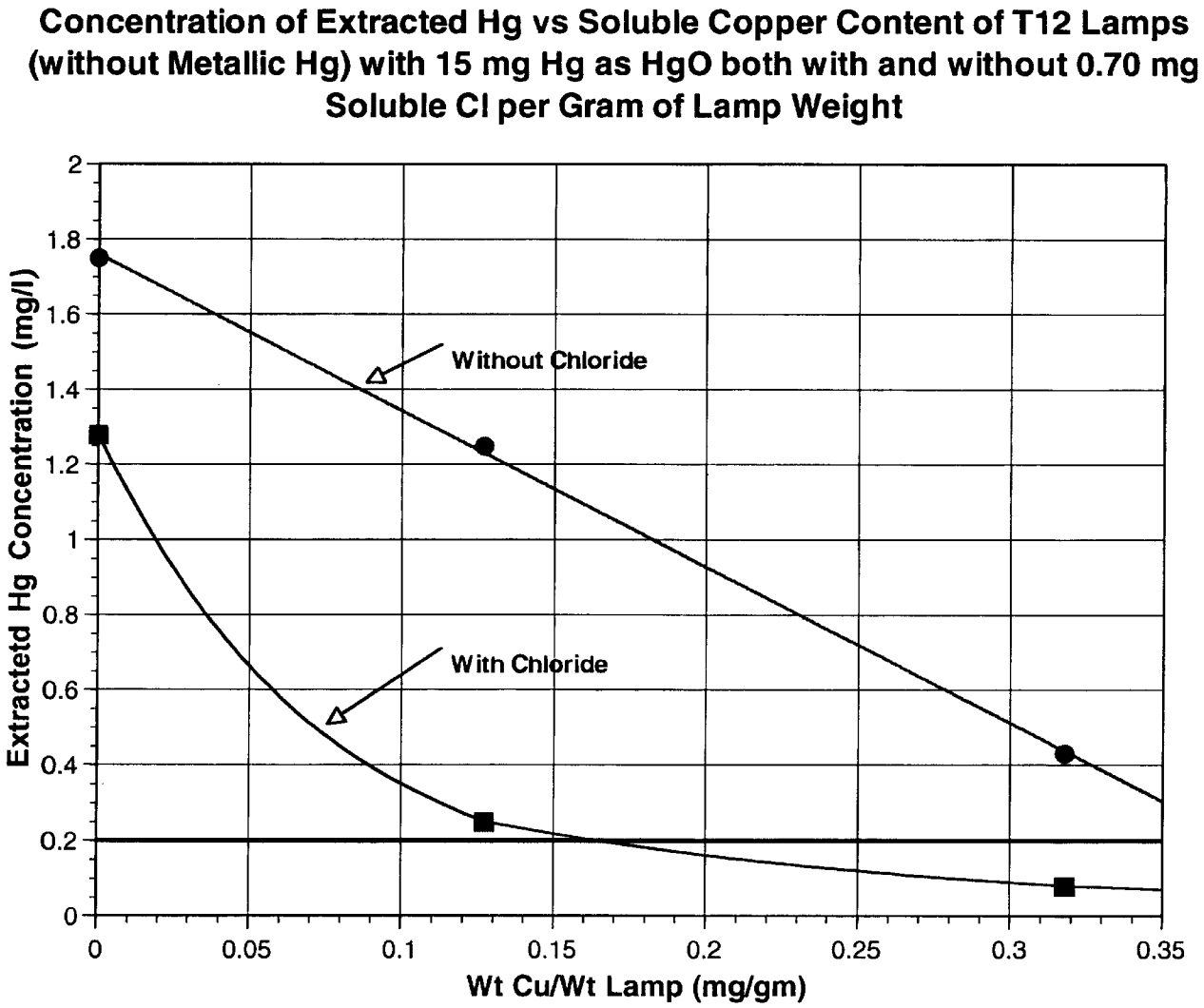
FIG. 8 is a graph illustrating extracted mercury concentration vs. content of soluble copper with and without soluble chloride.

Additional TCLP tests were carried out with 40WT12 fluorescent lamps manufactured without metallic mercury but with 15 mg of ionic mercury (as HgO) soluble in the TCLP extraction fluid. Half of the tests were performed with the addition of 0.7 mg soluble chloride (as NaCl) per gram of lamp weight, while no soluble chloride was included in the other half of the tests. Tests were performed with approximately 0.13 and 0.32 mg soluble copper (as $CuAc_2$) per gram of lamp weight both with and without the soluble chloride. The concentration of extracted Hg, both in the presence and absence of the soluble chloride, is plotted as a function of the quantity of soluble copper in FIG. 8. The extracted mercury concentrations measured without the soluble chloride were all greater than 0.4 mg/l while, by interpolation, it appears that extracted mercury levels less than 0.2 mg/l are obtained with amounts of soluble copper greater than about 0.2 mg per gram of lamp weight.

EXAMPLE 9

Figure 9:
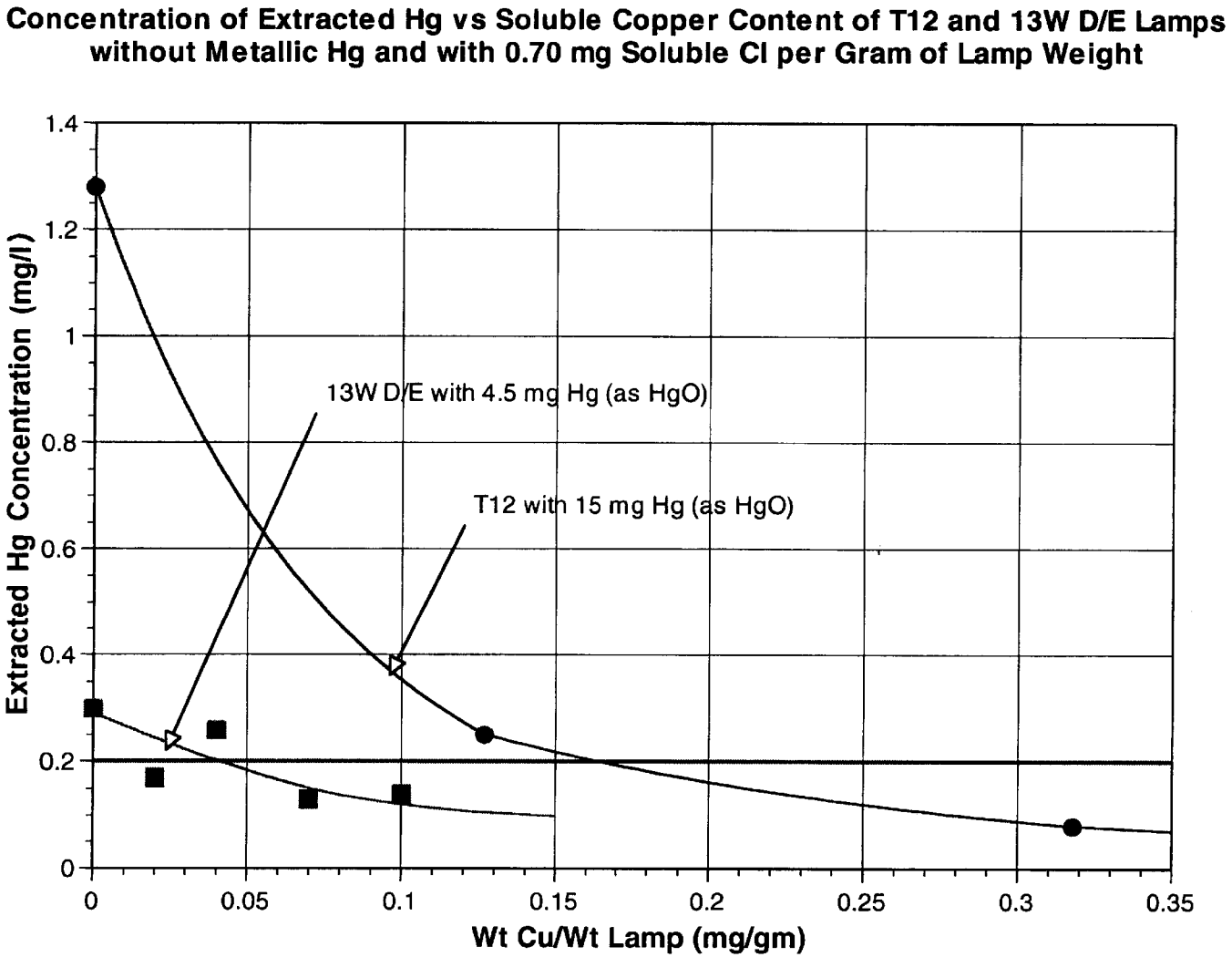
FIG. 9 is a graph illustrating extracted mercury concentration vs. soluble copper content with soluble chloride.

Another series of five TCLP tests were performed with 13W D/E compact fluorescent lamps manufactured without metallic mercury but with 4.5 mg of ionic mercury (as HgO) soluble in the TCLP extraction fluid. Each test also included 0.7 mg of soluble chloride (as NaCl) per gram of lamp weight. One test was performed without the addition of a soluble copper-containing compound, while each of the other four tests contained a quantity of soluble copper (as $CuAc_2$) ranging between 0.02 and 0.10 mg per gram of lamp weight. The concentration of extracted Hg is plotted as a function of the quantity of soluble copper in FIG. 9. Also plotted for comparison are the extracted mercury concentrations obtained with 40WT12 lamps, also manufactured without metallic mercury, but with 15 mg of ionic mercury (as HgO) and 0.7 mg soluble chloride (as NaCl) per gram of lamp weight (from Example 8). With the compact fluorescent lamps, it appears that extracted mercury levels less than 0.2 mg/l are obtained with amounts of soluble copper greater than about 0.05 mg per gram of lamp weight, roughly one-quarter of the soluble copper concentration required to obtain an equivalent extracted mercury concentration with a 40WT12 lamp containing about four times as much ionic (soluble) mercury.

26W D compact fluorescent lamps containing about 4.5 mg of metallic mercury in addition to 4.5 mg of ionic mercury (as HgO) were used in a series of related tests. In each test, a quantity of cupric acetate was included equivalent to about 0.06 mg of copper per gram of total lamp weight. Some of the tests also included 0.7 mg of soluble chloride (as NaCl) per gram of lamp weight. On average, the extracted mercury concentration obtained without the soluble chloride was 0.25 mg/l, compared to a 0.13 mg/l extracted mercury concentration when both soluble copper and soluble chloride were combined in the test.

EXAMPLE 10

Figure 10:
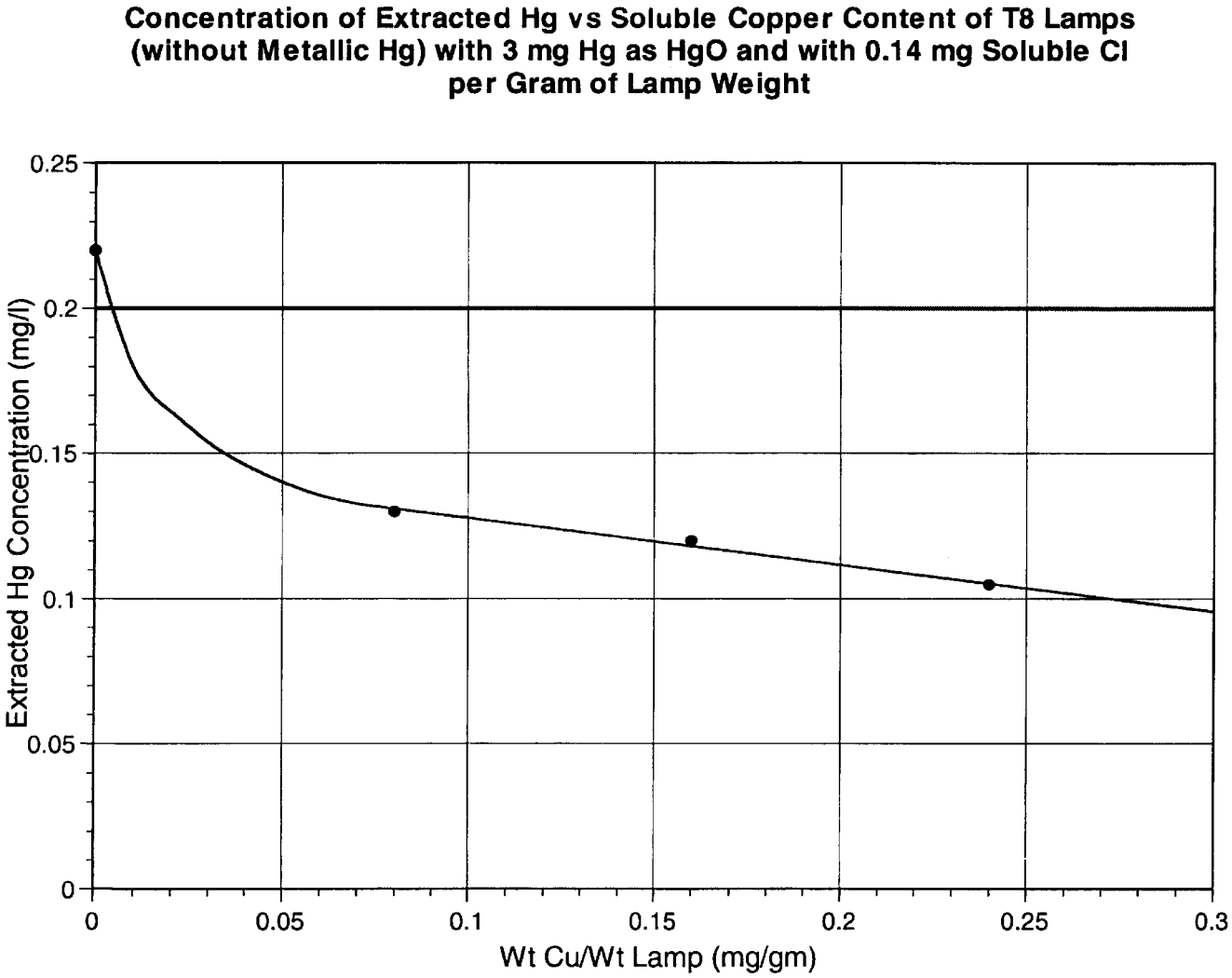
FIG. 10 is a graph illustrating extracted mercury concentration vs. soluble copper content with soluble chloride.

Another series of four TCLP tests were carried out with commercial 32WT8 fluorescent lamps manufactured without metallic mercury but with 3 mg of ionic mercury (as HgO) soluble in the TCLP extraction fluid. Also included in each test was 0.14 mg soluble chloride (as NaCl) per gram of lamp weight. A quantity of soluble copper (as CDC) ranging between approximately 0.08 and 0.24 mg per gram of lamp weight was also included in three of the four tests. The concentration of extracted mercury is plotted as a function of copper concentration in FIG. 10. As shown, with the addition of only 0.14 mg soluble chloride per gram of lamp weight, the presence of approximately 0.01 mg soluble copper per gram of lamp weight was sufficient to reduce the extracted mercury concentration to below 0.2 mg per liter.

EXAMPLE 11

Figure 11:
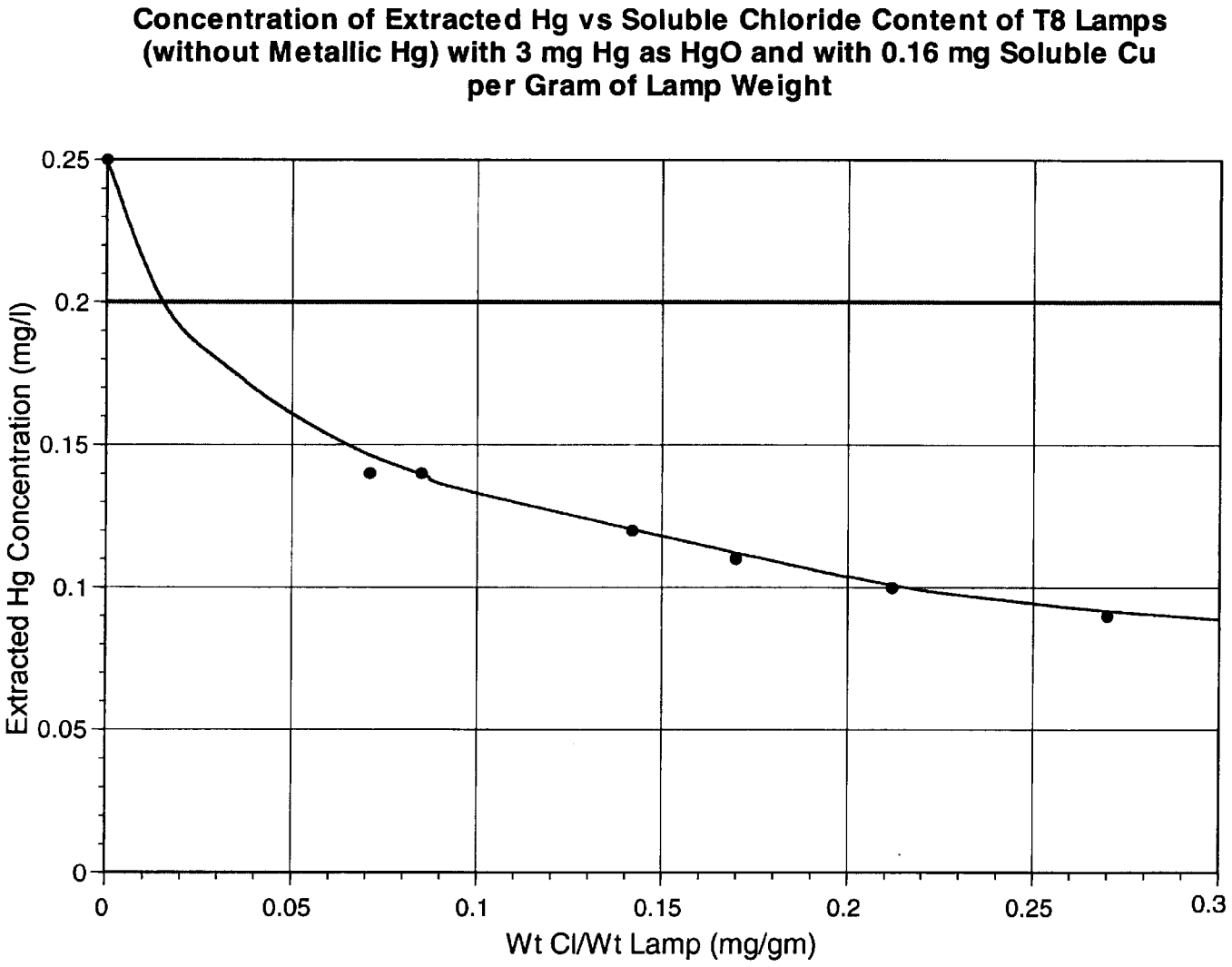
FIG. 11 is a graph illustrating extracted mercury concentration vs. soluble chloride content with soluble copper.

Another series of seven TCLP tests were carried out with commercial 32WT8 fluorescent lamps manufactured without metallic mercury but with 3 mg of ionic mercury (as HgO) soluble in the TCLP extraction fluid. Also included in each test was 0.16 mg soluble copper (as CDC) per gram of lamp weight. A quantity of soluble chloride (as NaCl)

ranging between approximately 0.07 and 0.27 mg per gram of lamp weight was also included in six of the seven tests. The concentration of extracted mercury is plotted as a function of chloride concentration in FIG. 11. As shown, with the addition of only 0.16 mg soluble copper per gram of lamp weight, the presence of approximately 0.02 mg soluble chloride per gram of lamp weight was sufficient to reduce the extracted mercury concentration to below 0.2 mg per liter.

EXAMPLE 12

Figure 12:
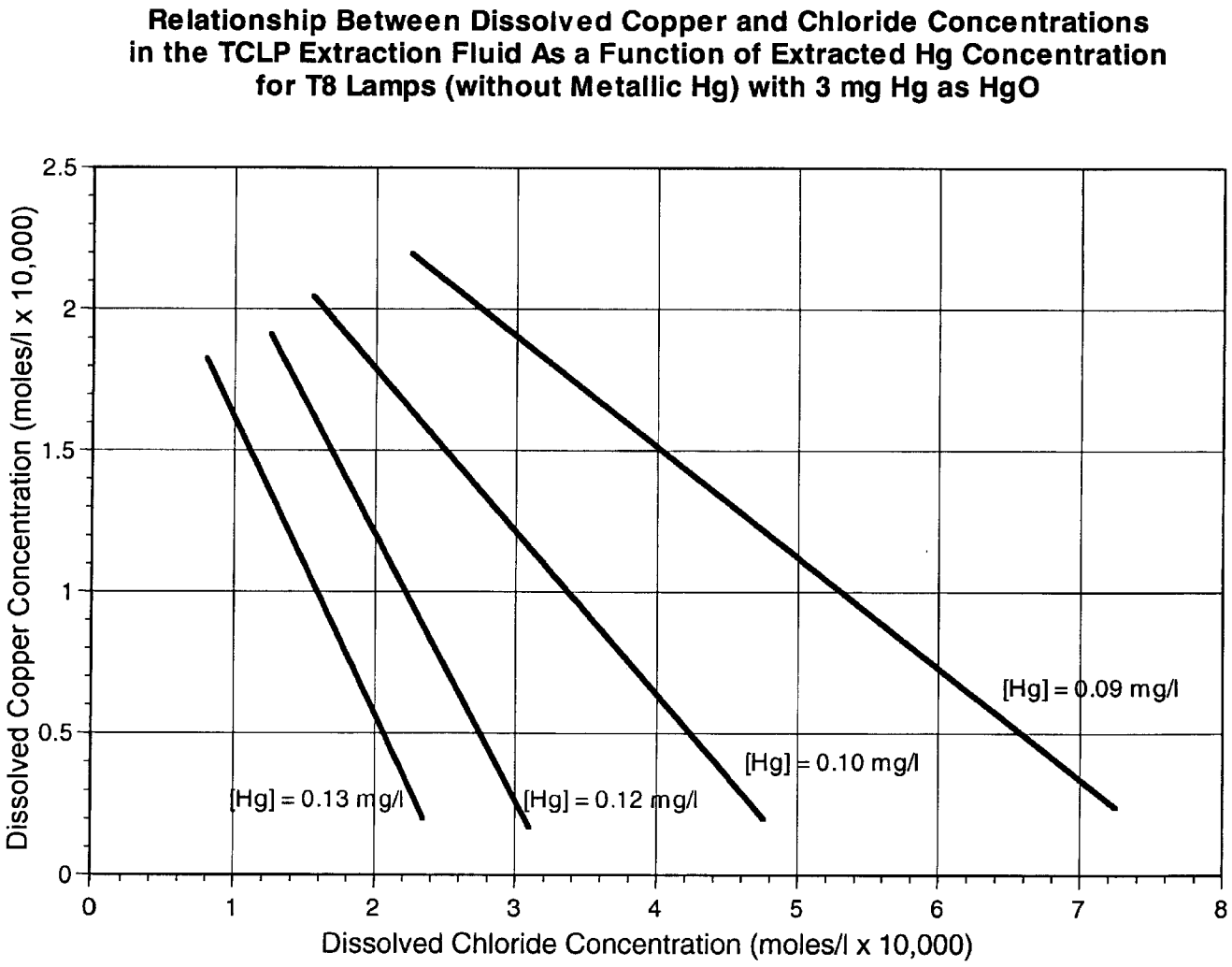
FIG. 12 is a graph illustrating dissolved copper concentration vs. dissolved chloride concentration.

A number of additional TCLP tests similar to those described in the above two examples were carried out with commercial 32WT8 fluorescent lamps manufactured without metallic mercury but with 3 mg of ionic mercury (as HgO) soluble in the TCLP extraction fluid. Each test contained a different amount of soluble copper-containing compound (CDC) and a different amount of soluble chloride (NaCl). From plots of extracted mercury concentration vs. dissolved copper or chloride concentration (such as those shown in FIGS. 10 and 11), tables were created showing the relationships between the concentrations of the two additives for selected extracted mercury concentrations ranging between 0.09 and 0.13 mg/l. These relationships are shown graphically in FIG. 12. For a particular extracted mercury concentration, there is an essentially linear relationship between the corresponding dissolved copper and chloride concentrations. Further, the lower the extracted mercury concentration, the greater the dissolved chloride concentration corresponding to a particular concentration of dissolved copper, and vice versa.

EXAMPLE 13

Figure 13:
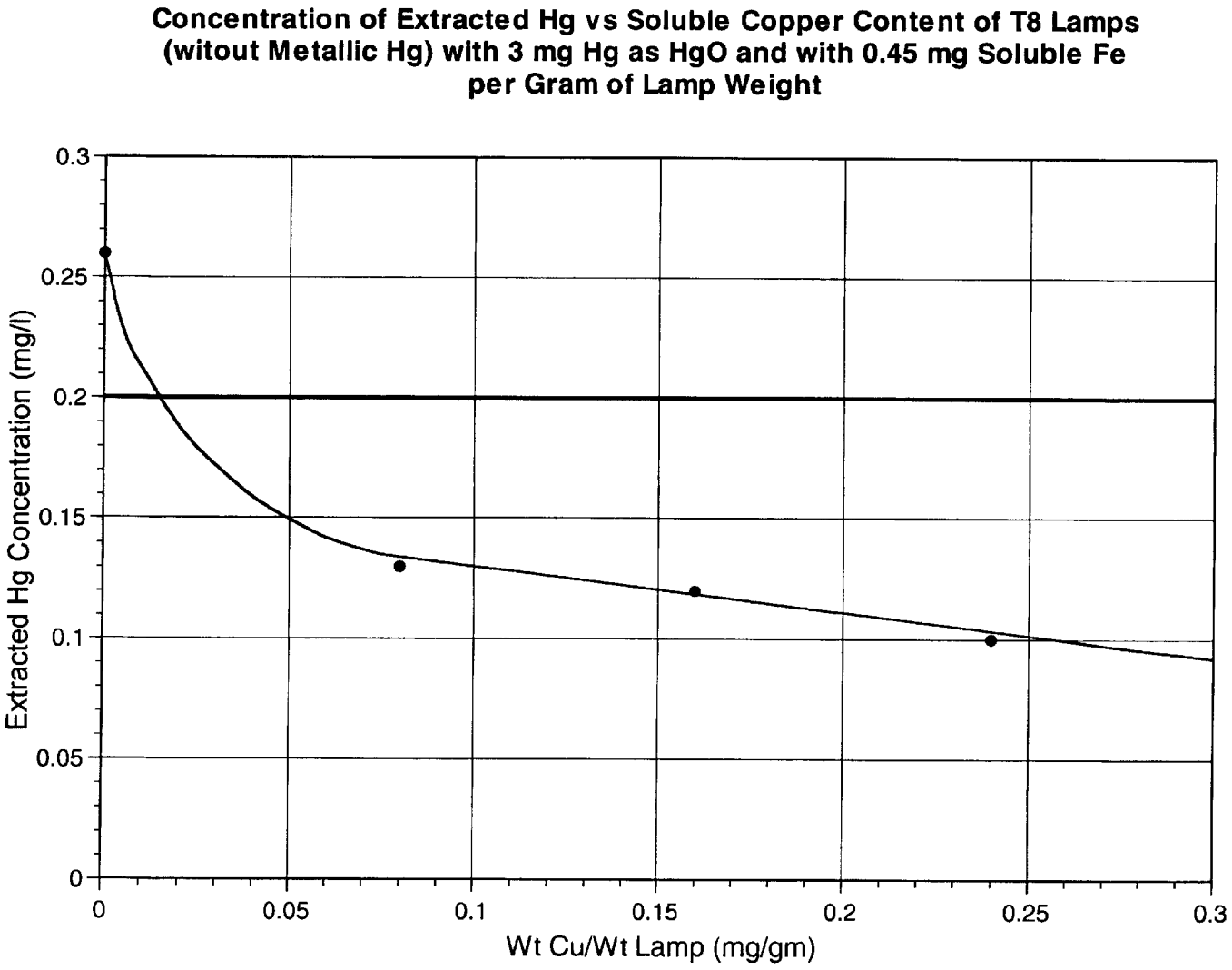
FIG. 13 is a graph illustrating extracted mercury concentration vs. soluble copper content with soluble iron.

Another series of four TCLP tests were carried out with commercial 32WT8 fluorescent lamps manufactured without metallic mercury but with 3 mg of ionic mercury (as HgO) soluble in the TCLP extraction fluid. Also included in each test was 0.45 mg soluble iron (as $Fe_2(SO_4)_3$) per gram of lamp weight. A quantity of soluble copper (as CDC) ranging between approximately 0.08 and 0.24 mg per gram of lamp weight was also included in three of the four tests. The concentration of extracted mercury is plotted as a function of copper concentration in FIG. 13. As shown, with the addition of only 0.45 mg soluble iron per gram of lamp weight, the presence of approximately 0.02 mg soluble copper per gram of lamp weight was sufficient to reduce the extracted mercury concentration to below 0.2 mg per liter.

EXAMPLE 14

Figure 14:
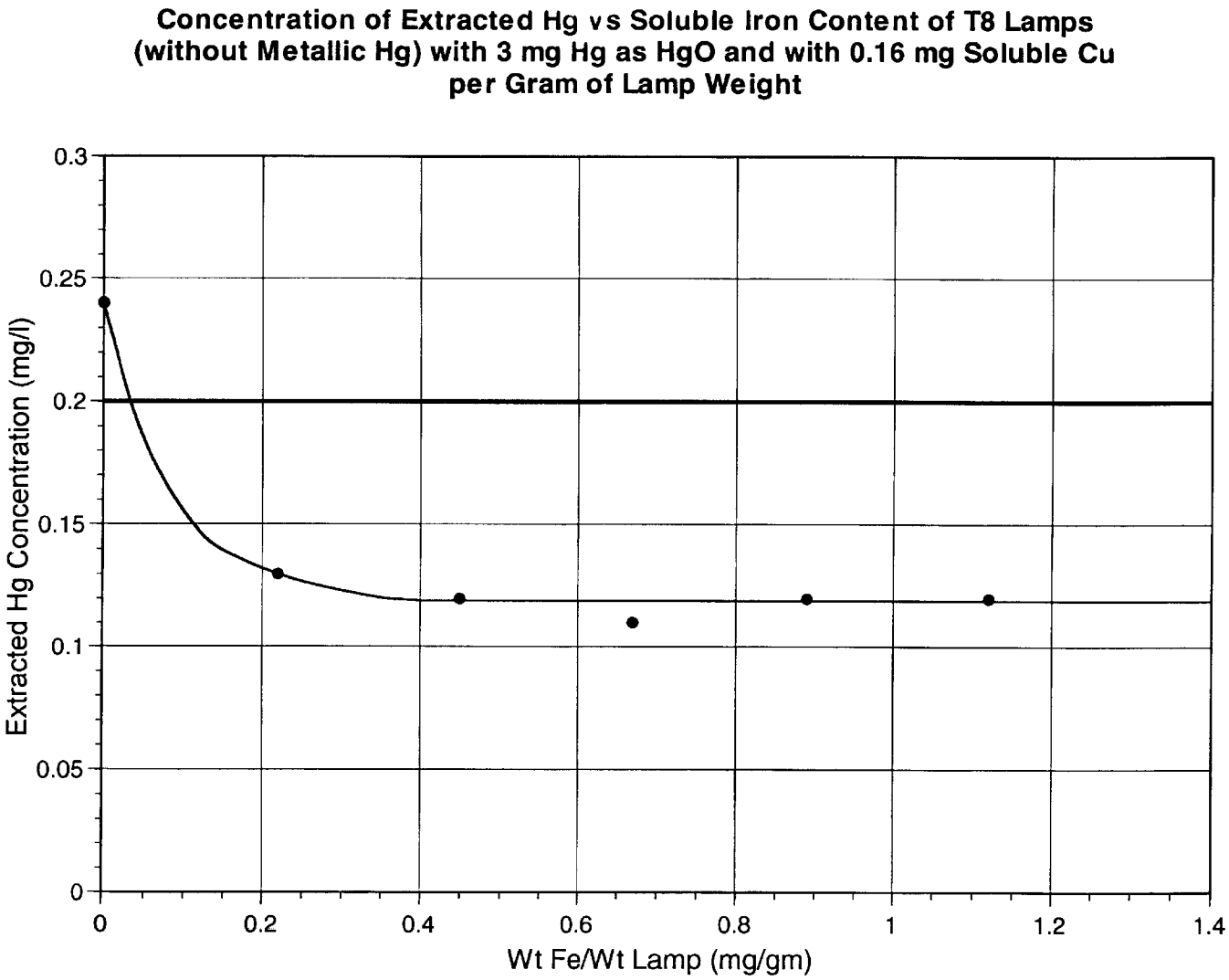
FIG. 14 is a graph illustrating extracted mercury concentration vs. soluble iron content with soluble copper.

Another series of six TCLP tests were carried out with commercial 32WT8 fluorescent lamps manufactured without metallic mercury but with 3 mg of ionic mercury (as HgO) soluble in the TCLP extraction fluid. Also included in each test was 0.16 mg soluble copper (as CDC) per gram of lamp weight. A quantity of soluble iron (as $Fe_2(SO_4)_3$) ranging between approximately 0.2 and 1.1 mg per gram of lamp weight was also included in five of the six tests. The concentration of extracted mercury is plotted as a function of iron concentration in FIG. 14. A shown, with the addition of only 0.16 mg soluble copper per gram of lamp weight, the presence of approximately 0.04 mg soluble iron per gram of lamp weight was sufficient to reduce the extracted mercury concentration to below 0.2 mg per liter.

EXAMPLE 15

Two additional TCLP tests were performed using 40WT12 fluorescent lamps manufactured without metallic mercury but with 15 mg of ionic mercury (as HgO) soluble in the TCLP extraction fluid. In one test, a quantity of soluble manganese (II) acetate was included sufficient to produce a $1.0\times10^{-3}$ M concentration in the extraction fluid. In the other tests, the same amount of $MnAc_2$ was included along with a quantity of soluble copper (II) acetate ($CuAc_2$) sufficient to produce a $2.5\times10^{-4}$ concentration in the extraction fluid. The resulting extracted mercury concentrations are listed in Table V below, along with the results of other tests (described in Example 2) in which no additives were used or in which the only additive was $CuAc_2$.

TABLE V

TCLP Results for T12 Lamps without $Hg^0$, and with 15 mg Dissolved $Hg^{2+}$ (from HgO), and with Soluble Copper-Containing and/or Manganese-Containing Compounds as Additives

| Soluble Additive Concentrations In the TCLP Extraction Fluid | Leached Hg (mg/l) |
|---|---|
| None | 1.75 |
| $2.4 \times 10^{-4}$ M Cu (from $CuAc_2$) | 0.43 |
| $1.0 \times 10^{-3}$ M Mn (from $MnAc_2$) | 0.39 |
| $2.5 \times 10^{-4}$ M Cu (from $CuAc_2$) + $1.0 \times 10^{-3}$ M Mn (from $MnAc_2$) | 0.04 |

These data show that the extracted mercury concentration obtained when soluble copper is combined with soluble manganese may be much lower than with either of the additives used alone.

There is thus provided an improved mercury vapor discharge lamp containing means for limiting leachable mercury, as determined by the TCLP, which means include a copper-containing compound, and which limits the level of soluble copper used to limit the leachable mercury by use of selected ones of soluble chloride, soluble bromide, compounds of manganese, and compounds of iron.

It is understood that the present invention is by no means limited to the particular materials herein disclosed and/or shown in the drawings, but also comprises any modifications or equivalents within the scope of the claims.

What is claimed is:

1. In a mercury vapor discharge lamp having an envelope of light-transmitting vitreous material containing an inert starting gas and a quantity of elemental mercury at least in part convertible to soluble mercury, and first and second electrodes located within said envelope for an arc discharge therebetween, the improvement comprising an effective amount of a soluble non-metallic copper-containing compound in combination with an effective amount of a selected one of a group of materials consisting of a soluble chloride, a soluble bromide, a soluble nonmetallic iron-containing compound, and a soluble nonmetallic manganese-containing compound, wherein said copper-containing compound and said material in combination, when the lamp is particulated into granules and subjected to a suitable aqueous acid extraction solution, dissolve in said aqueous acid solution, resulting in a concentration of extracted mercury less than about 0.2 mg/l of the extraction solution, and wherein said effective amount of said copper-containing compound is substantially smaller than is required to produce said concentration of extracted mercury without said materials present, and wherein said effective amount of said selected material is smaller than is required to produce said concentration of extracted mercury without said copper-containing compound present.

2. The lamp in accordance with claim 1 wherein said soluble non-metallic copper-containing compound comprises a selected one of cupric acetate ($CuAc_2$), copper dihydroxy carbonate ($Cu_2(OH)_2CO_3$), and copper oxy chloride ($Cu_2(OH)_3Cl$).

3. The lamp in accordance with claim 2 wherein said soluble chloride comprises a selected one of sodium chloride (NaCl) and copper oxy chloride.

4. The lamp in accordance with claim 2 wherein said soluble bromide comprises sodium bromide (NaBr).

5. The lamp in accordance with claim 2 wherein said soluble nonmetallic iron-containing compound comprises a selected one of ferric sulphate ($Fe_2(SO_4)_3$), ferrous sulphate ($FeSO_4$), and Fe (II) Fumerate.

6. The lamp in accordance with claim 2 wherein said soluble nonmetallic manganese-containing compound comprises manganese acetate ($MnAc_2$).

* * * * *